US011739703B2

(12) United States Patent
Ogawa et al.

(10) Patent No.: US 11,739,703 B2
(45) Date of Patent: Aug. 29, 2023

(54) VEHICLE CONTROL SYSTEM

(71) Applicant: Mazda Motor Corporation, Hiroshima (JP)

(72) Inventors: Daisaku Ogawa, Aki-gun (JP); Daisuke Umetsu, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/669,594

(22) Filed: Feb. 11, 2022

(65) Prior Publication Data

US 2022/0282681 A1 Sep. 8, 2022

(30) Foreign Application Priority Data

Mar. 2, 2021 (JP) ..... 2021-032775

(51) Int. Cl.
*F02D 41/12* (2006.01)
*F02D 41/02* (2006.01)
*F02P 5/145* (2006.01)

(52) U.S. Cl.
CPC ..... *F02D 41/12* (2013.01); *F02D 41/021* (2013.01); *F02P 5/145* (2013.01); *F02D 2200/50* (2013.01); *F02D 2200/602* (2013.01); *F02D 2200/604* (2013.01); *F02D 2250/18* (2013.01)

(58) Field of Classification Search
CPC .... F02D 41/12; F02D 41/021; F02D 2200/50; F02D 2200/602; F02D 2200/604; F02D 2250/18; F02D 11/105; F02D 41/045; F02D 41/1497; F02P 5/145; Y02T 10/72
See application file for complete search history.

(56) References Cited

U.S. PATENT DOCUMENTS

| | | | | |
|---|---|---|---|---|
| 10,706,270 | B2 * | 7/2020 | Goto | G06V 40/174 |
| 10,773,726 | B2 * | 9/2020 | Goto | B60W 50/14 |
| 10,850,726 | B2 | 12/2020 | Yoshioka et al. | |
| 2019/0294867 | A1 * | 9/2019 | Goto | G06Q 30/02 |
| 2019/0300004 | A1 * | 10/2019 | Goto | B60W 50/14 |

FOREIGN PATENT DOCUMENTS

| | | | | |
|---|---|---|---|---|
| CN | 112078561 | A * | 12/2020 | |
| JP | 6202479 | B1 | 9/2017 | |
| KR | 2042825 | B1 * | 11/2019 | B60L 15/20 |
| WO | WO-2008148806 | A1 * | 12/2008 | B62D 7/1581 |
| WO | WO-2009095487 | A1 * | 8/2009 | B60K 35/00 |

* cited by examiner

*Primary Examiner* — Joseph J Dallo
(74) *Attorney, Agent, or Firm* — Alleman Hall Creasman & Tuttle LLP

(57) ABSTRACT

A control system for a vehicle is provided, which includes a driving force source configured to generate torque for driving drive wheels, a steering angle related value sensor configured to detect a steering angle related value of a steering device, and a controller configured to control the torque to control the vehicle attitude based on the steering angle related value. The controller acquires a current traveling mode defining a response of acceleration or deceleration of the vehicle to an accelerator pedal operation. Based on the steering angle related value, when determined that a turning operation of the steering device in one direction is performed, the controller performs a torque decreasing control to add deceleration to the vehicle. When the acquired traveling mode is a high response traveling mode, the controller increases a reduction amount of the torque in the torque decreasing control more than in a low response traveling mode.

8 Claims, 6 Drawing Sheets

VEHICLE CONTROL SYSTEM

TECHNICAL FIELD

The present disclosure relates to a control system for a vehicle, which controls attitude of the vehicle according to steering.

BACKGROUND OF THE DISCLOSURE

Conventionally, a technique is known for controlling the vehicle attitude by causing deceleration or acceleration in the vehicle according to a driver's operation of a steering wheel to improve the response and the stability of the vehicle behavior with respect to the steering operation. For example, when the steering wheel is turned in one direction, the driving force of the vehicle is reduced to add the deceleration. This control increases the load of front wheels corresponding to the turning of the steering wheel, and therefore, the cornering force of the front wheels increases. Thus, the turnability of the vehicle in the early stage of the curve entry improves, and the response and the steering stability for the turning operation of the steering wheel improve (e.g., JP6202479B1).

Meanwhile, a control device for a vehicle which controls an engine and an automatic transmission to correspond to a traveling mode selected by a driver is known. The traveling mode is selectable from at least two traveling modes, which includes a normal traveling mode (for example, a traveling mode referred to as "normal mode"), and a traveling mode in which the response of acceleration or deceleration of the vehicle to a driver's accelerator pedal operation is improved (for example, a traveling mode referred to as "sport mode"). For example, when the sport mode is selected, the output torque of the engine is controlled to become higher than when the normal mode is selected.

Thus, it is possible to apply the conventional vehicle attitude control which is described in JP6202479B1 to the vehicle in which the traveling mode is selectable. However, according to the above conventional technique, although the response of the acceleration or deceleration to the accelerator pedal operation changes by changing the traveling mode, the response of the vehicle attitude control to the turning operation of the steering wheel in one direction does not change even if the traveling mode is changed. Therefore, the response of the vehicle to the accelerator pedal operation and the response of the vehicle to the steering operation may not be balanced, and may cause the driver discomfort.

SUMMARY OF THE DISCLOSURE

The present disclosure is made in view of solving the problems described above, and one purpose thereof is to provide a control system for a vehicle, capable of controlling attitude of the vehicle according to steering, and changing the response of acceleration or deceleration of the vehicle to operation of an accelerator pedal according to a traveling mode. In this system, the integrity between the response of the vehicle to the accelerator pedal operation and the response of the vehicle to the operation of a steering device can be achieved in any traveling mode.

According to one aspect of the present disclosure, a control system for a vehicle is provided, which includes a driving force source configured to generate torque for driving drive wheels of the vehicle, a steering angle related value sensor configured to detect a steering angle related value of a steering device of the vehicle, and a controller configured to control the torque generated by the driving force source to control attitude of the vehicle based on the steering angle related value. The controller acquires a current traveling mode defining a response of acceleration or deceleration of the vehicle to operation of an accelerator pedal. The controller performs, based on the steering angle related value, when the controller determines that a turning operation of the steering device in one direction is carried out, a torque decreasing control for reducing the torque generated by the driving force source so as to add deceleration to the vehicle. The controller increases, when the acquired traveling mode is a traveling mode in which the response is high, a reduction amount of the torque in the torque decreasing control more than when in a traveling mode in which the response is low.

According to this configuration, when the traveling mode in which the response of the acceleration or deceleration of the vehicle is high is selected, the response of the acceleration or deceleration of the vehicle to the operation of the accelerator pedal becomes higher, and also the response of the vehicle to the operation of the steering device becomes higher, than when the traveling mode in which the response is low is selected. Therefore, even when any of the traveling modes is selected, the response of the vehicle to the accelerator pedal operation and the response of the vehicle to the steering operation can be balanced, and the integrity can be given to the change in the response to each of the accelerator pedal operation and the steering operation when the traveling mode is changed.

The control system may further include a traveling mode selection switch configured to accept an operation for selecting one of a plurality of traveling modes. The controller may acquire the current traveling mode based on the operation of the traveling mode selection switch.

According to this configuration, according to the traveling mode selected reflecting the intention of the driver, the response of the vehicle to the accelerator pedal operation and the response of the vehicle to the steering operation can be changed while maintaining the integrity therebetween.

The steering angle related value may be a steering angle.

According to this configuration, the vehicle attitude can be controlled promptly to improve the response and the stability of the vehicle behavior with respect to the driver's steering operation.

The steering angle related value may be one of a steering angle, an angular velocity of the steering angle, a yaw rate, and a lateral acceleration.

The traveling mode in which the response is low may be a normal mode, and the traveling mode in which the response is high may be a sport mode in which a target acceleration of the vehicle corresponding to an accelerator opening is higher than that in the normal mode.

DETAILED DESCRIPTION OF THE DISCLOSURE

Hereinafter, a control system for a vehicle according to one embodiment of the present disclosure is described with reference to the accompanying drawings.

<Configuration of Vehicle>

Figure 1:
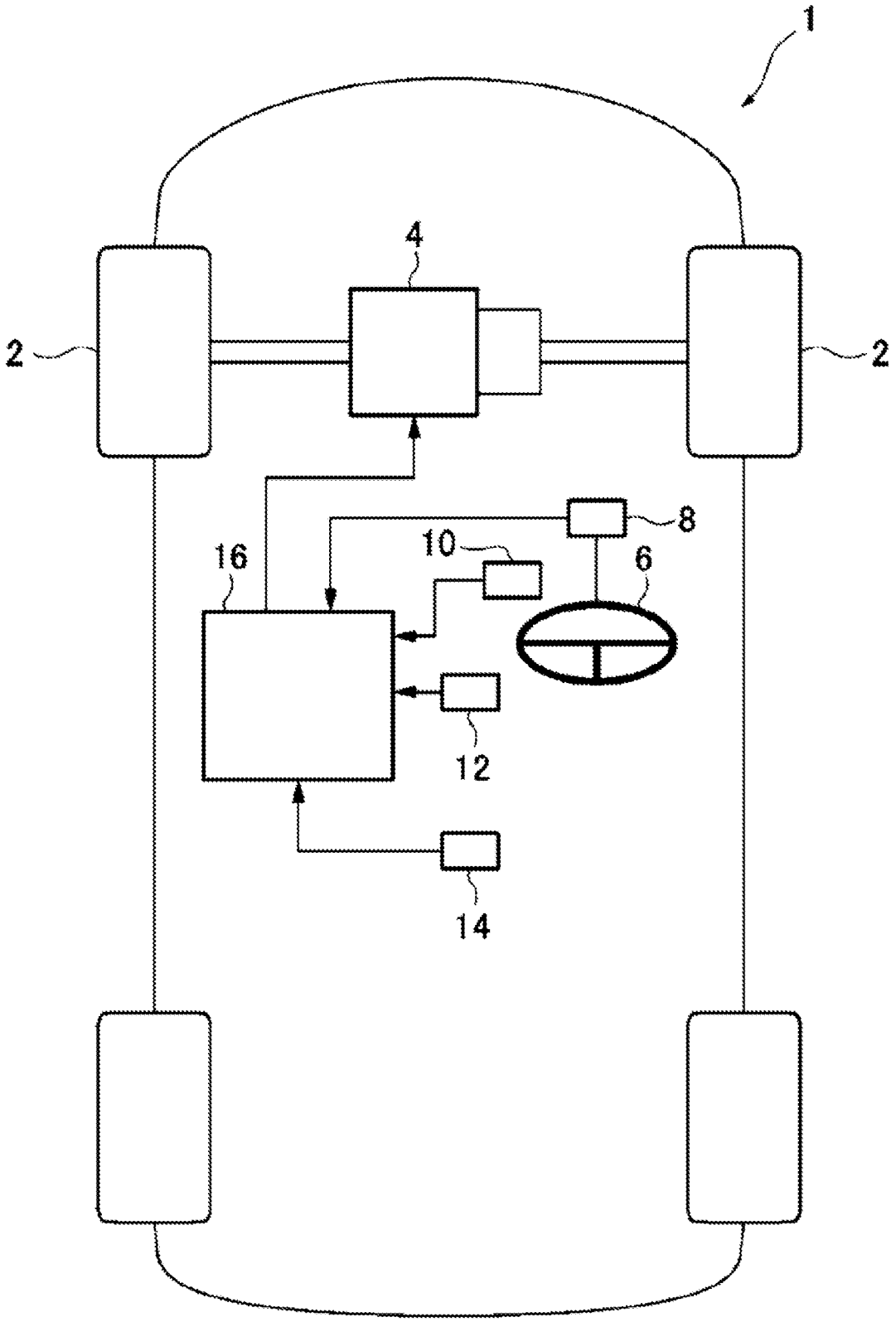
FIG. 1 is a block diagram schematically illustrating the overall configuration of a vehicle according to one embodiment of the present disclosure.

First, referring to FIG. 1, the vehicle to which the control system for the vehicle according to this embodiment is applied is described. FIG. 1 is a block diagram schematically illustrating the overall configuration of the vehicle according to this embodiment.

As illustrated in FIG. 1, an engine 4 is mounted on a front part of a vehicle 1, as a motor (driving force source) which drives left and right front wheels 2 which are drive wheels. The engine 4 is an internal combustion engine, such as a gasoline engine or a diesel engine, and in this embodiment, it is a gasoline engine having a throttle valve 26, a spark plug 28, a variable valve mechanism 30, and a fuel injection device 32. This vehicle 1 is configured as a so-called "front-engine, front-wheel drive (FF) vehicle."

The vehicle 1 includes a steering device (a steering wheel 6, etc.) for steering the vehicle 1, a steering angle sensor 8 which detects a turning angle of a steering column (not illustrated) coupled to the steering wheel 6 in this steering device, a gyroscope 34 which detects a yaw rate of the vehicle 1 (see FIG. 2), an accelerometer 36 which detects a lateral acceleration of the vehicle (see FIG. 2), an accelerator opening sensor 10 which detects an accelerator opening equivalent to a stepping amount of an accelerator pedal, a vehicle speed sensor 12 which detects a traveling speed of the vehicle 1, and a traveling mode switch 14 for a selection of a traveling mode of the vehicle 1 by a driver. Note that the steering angle sensor 8 may detect various properties in the steering system (a rotation angle of a motor which applies assisting torque, a displacement of a rack in a rack-and-pinion mechanism), and a steered angle (tire angle) of the front wheels 2, as the steering angle, instead of the turning angle of the steering wheel 6. Further, the traveling mode switch 14 is a traveling mode selection switch which accepts an operation for selecting one of a plurality of traveling modes (for example, a normal mode and a sport mode). For example, it may be comprised of a toggle switch, which is disposed near a shift lever or the steering wheel 6 so as to be easily operated by the driver. Each sensor and switch outputs the detection values to a controller 16. This controller 16 is comprised of a PCM (Power-train Control Module), for example.

Figure 2:
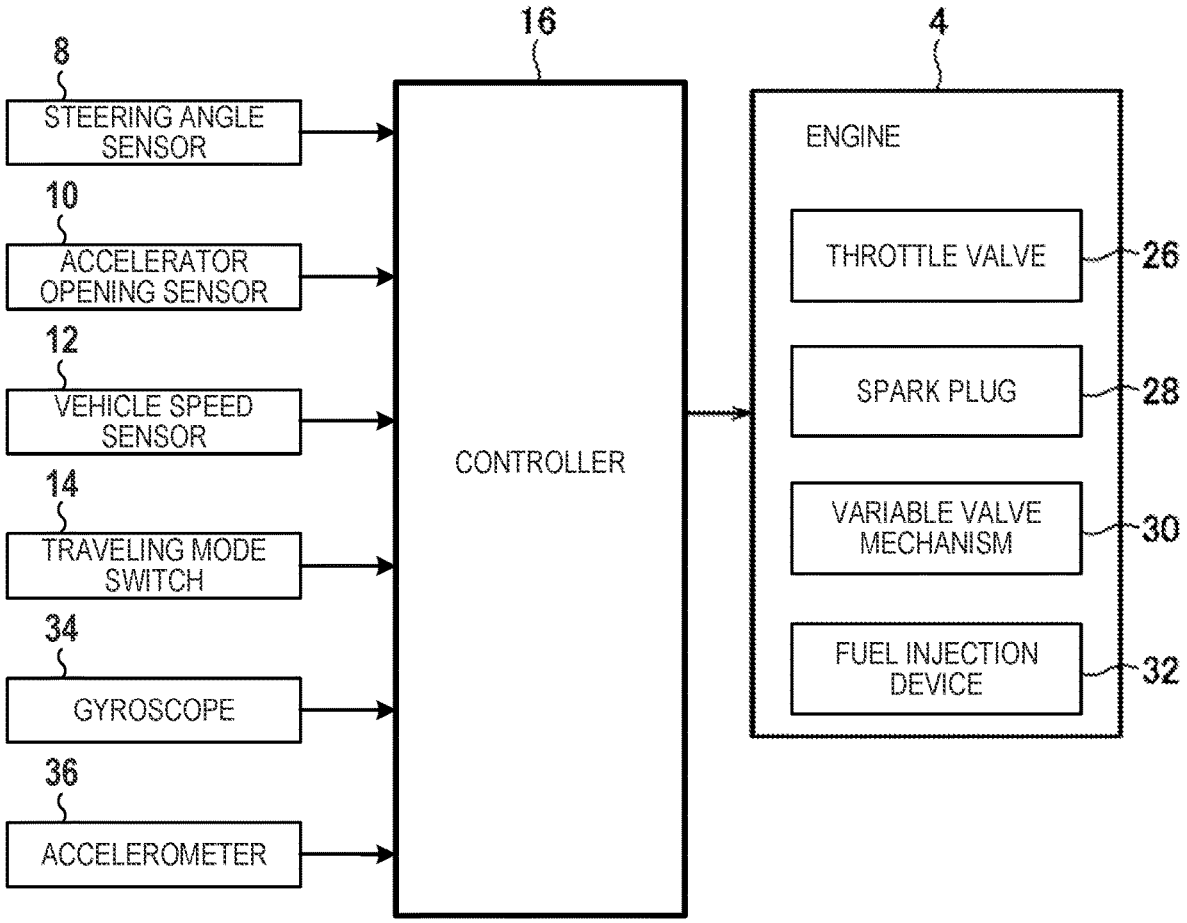
FIG. 2 is a block diagram illustrating an electric configuration of the vehicle according to this embodiment.

Next, referring to FIG. 2, an electric configuration of a control device for the vehicle according to this embodiment is described. FIG. 2 is a block diagram illustrating the electric configuration of the control device for the vehicle according to this embodiment.

As illustrated in FIG. 2, based on detection signals outputted from various sensors which detect the operating state of the vehicle 1, in addition to detection signals from the sensors 8, 10, 12, 34, and 36 and the traveling mode switch 14, the controller 16 outputs a control signal to perform a control of each part of the engine 4 (for example, the throttle valve 26, the spark plug 28, the variable valve mechanism 30, the fuel injection device 32, etc.).

The controller 16 is comprised of a circuitry and is a controller based on a well-known microcomputer. The controller 16 includes one or more microprocessors as a CPU (Central Processing Unit) which executes a program, memory which is comprised of, for example, RAM (Random Access Memory) and/or ROM (Read Only Memory), and stores the program and data, an input/output bus which performs input/output of an electric signal. Note that the system including the steering wheel 6, the steering angle sensor 8, the traveling mode switch 14, and the controller 16 is an example of a control system for the vehicle in the present disclosure.

<Vehicle Attitude Control>

Below, a vehicle attitude control according to this embodiment is described. Fundamentally, in this embodiment, the controller 16 controls vehicle attitude (vehicle behavior) based on the steering angle detected by the steering angle sensor 8. In detail, when the steering wheel 6 is turned in one direction so that it separates from the neutral position (i.e., when the steering angle increases), the controller 16 performs a torque decreasing control to reduce torque generated by the engine 4 so that a deceleration is added to the vehicle 1 (i.e., deceleration to decelerate the vehicle 1 which moves forward). By performing such a torque decreasing control, it can improve the turnability and the steering stability of the vehicle 1 when entering into a corner.

Note that, below, torque which is applied to the torque decreasing control, i.e., a negative torque which is added to the torque generated by the engine 4 in order to add the deceleration to the vehicle 1 is referred to as the "reducing torque." In the torque decreasing control, the reducing torque is subtracted from the torque which is to be generated by the engine 4 (hereinafter, referred to as the "basic torque") in order to achieve the acceleration according to the operating state of the vehicle 1 (accelerator opening, etc.). Below, the torque after the reducing torque is thus subtracted (i.e., the torque to be finally generated by the engine 4) is referred to as the "final target torque" with respect to the basic torque.

Figure 3:
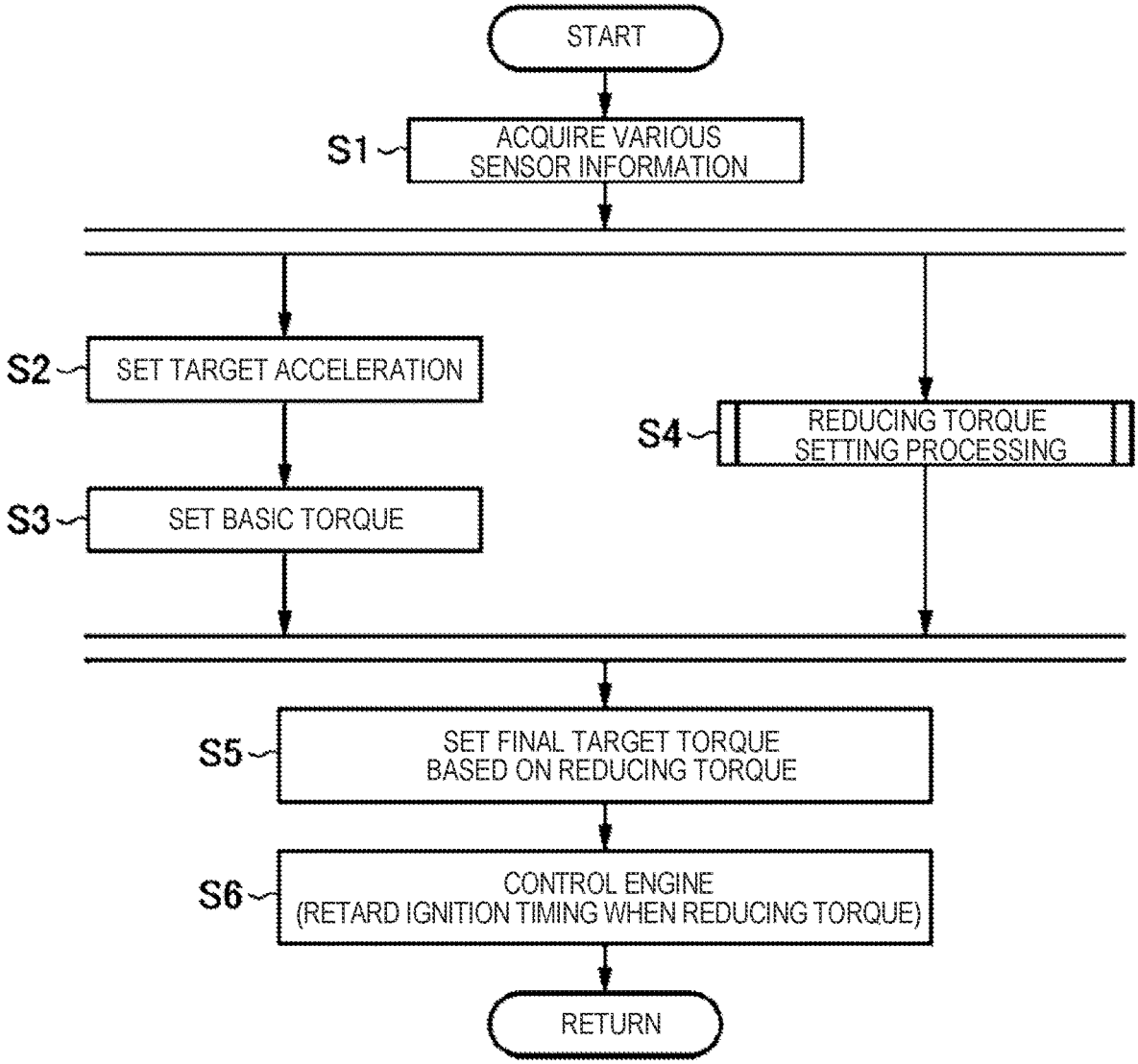
FIG. 3 is a flowchart of a torque decreasing control processing according to this embodiment.

Next, referring to FIG. 3, the overall flow of the torque decreasing control according to this embodiment is described. FIG. 3 is a flowchart of the torque decreasing control processing according to this embodiment.

The torque decreasing control processing in FIG. 3 is started when the ignition of the vehicle 1 is turned ON and the power is supplied to the controller 16, and it is repeatedly performed at a given period (for example, 50 ms). As the torque decreasing control processing is started, at Step S1, the controller 16 acquires various sensor information on the operating state of the vehicle 1. In detail, the controller 16 acquires, as the information on the operating state, the detection signals outputted from the various sensors including the steering angle detected by the steering angle sensor 8, the accelerator opening detected by the accelerator opening sensor 10, the traveling speed detected by the vehicle speed sensor 12, and the current traveling mode selected by the traveling mode switch 14.

Next, at Step S2, the controller 16 sets a target acceleration based on the operating state of the vehicle 1 acquired at Step S1. In detail, for example, the controller 16 selects, from acceleration characteristics maps (created beforehand and stored in the memory, etc.) in which various traveling speeds, various gear stages, and various traveling modes are defined, an acceleration characteristics map corresponding to the current traveling speed, the current gear stage, and the current traveling mode, and sets the target acceleration corresponding to the current accelerator opening with reference to the selected acceleration characteristics map.

The response of the acceleration or deceleration of the vehicle 1 to the operation of the accelerator pedal is defined for each of the plurality of traveling modes. For example, the traveling mode includes the normal mode and the sport mode. Here, the sport mode is a traveling mode in which the response of the acceleration or deceleration of the vehicle 1 to the accelerator pedal operation is higher than the normal mode. That is, in the sport mode, the target acceleration is set higher than the normal mode for the same accelerator opening. In other words, when the sport mode is selected, the change in the target acceleration with respect to the change in the accelerator opening becoming larger than when the normal mode is selected. Note that the traveling mode may not necessarily use the term "mode," as long as it defines the response of the acceleration or deceleration of the vehicle 1 to the accelerator pedal operation.

Next, at Step S3, the controller 16 sets the basic torque of the engine 4 for achieving the target acceleration set at Step S2. In this case, the controller 16 sets the basic torque within the outputtable torque range of the engine 4, based on the current traveling speed, gear stage, road surface gradient, road surface μ, etc.

Further, at Step S4, in parallel to the processing at Steps S2 and S3, the controller 16 performs the reducing torque setting processing which will be described later (see FIG. 4), and based on the steering speed, etc. of the steering wheel 6, it sets the reducing torque to be applied to the torque generated by the engine 4 in order to control the vehicle attitude.

Next, at Step S5 after Steps S2 to S4, the controller 16 sets the final target torque based on the basic torque set at Step S3 and the reducing torque set at Step S4. Fundamentally, the controller 16 calculates the final target torque by subtracting the reducing torque from the basic torque.

Next, at Step S6, the controller 16 controls the engine 4 to output the final target torque set at Step S5. In detail, based on the final target torque set at Step S5 and the engine speed, the controller 16 determines various properties (for example, an air filling amount, a fuel injection amount, an intake air temperature, an oxygen concentration, etc.) which are required for achieving the final target torque, and based on the properties, controls actuators which drive the respective components of the engine 4. In this case, the controller 16 sets a limit value and a limit area according to the properties, and sets such a controlled variable for each actuator that the properties comply the limit value and the limit area, and performs the control.

In more detail, the controller 16 reduces the torque generated by the engine 4 by retarding an ignition timing of the spark plug 28 with respect to an ignition timing at which the basic torque is set to the final target torque as it is at Step S5. Note that, when the engine 4 is a diesel engine, the controller 16 can reduce the torque generated by the engine 4 by reducing the fuel injection amount from a fuel injection amount at which the basic torque is set to the final target torque as it is at Step S5. After Step S6, the controller 16 ends the torque decreasing control processing.

Figure 4:
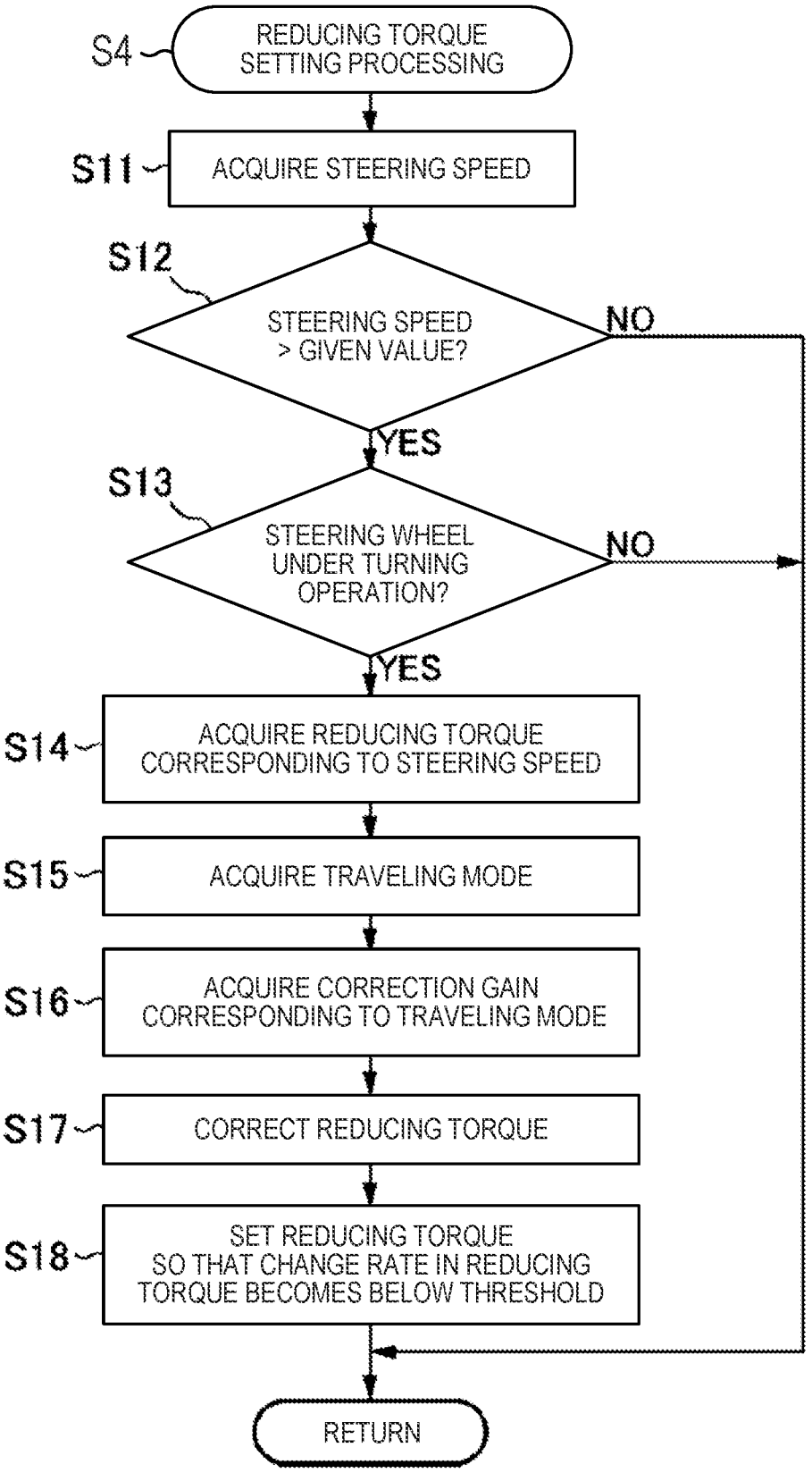
FIG. 4 is a flowchart of a reducing torque setting processing according to this embodiment.

Next, referring to FIG. 4, the reducing torque setting processing according to this embodiment is described. FIG. 4 is a flowchart of the reducing torque setting processing according to this embodiment. This reducing torque setting processing is performed at Step S4 of the torque decreasing control processing illustrated in FIG. 3.

When the reducing torque setting processing is started, at Step S11, the controller 16 acquires the steering speed based on the steering angle acquired from the steering angle sensor 8 at Step S1 of the torque decreasing control processing illustrated in FIG. 3. Next, at Step S12, the controller 16 determines whether the steering speed acquired at Step S11 is above a given value. As a result, when the controller 16 determines that the steering speed is above the given value (Step S12: YES), it shifts to Step S13.

On the other hand, when the controller 16 does not determine that the steering speed is above the given value (Step S12: NO), it ends the reducing torque setting processing, and returns to the main routine. In this case, the reducing torque becomes 0, and the basic torque set at Step S3 of the torque decreasing control processing illustrated in FIG. 3 becomes the final target torque.

Next, at Step S13, the controller 16 determines whether the steering wheel 6 is under the turning operation. In detail, for example, when an absolute value of the steering angle acquired from the steering angle sensor 8 is increasing (i.e., when the steering angle of the steering wheel 6 is separating from the neutral position), the controller 16 determines that the steering wheel 6 is under the turning operation. On the other hand, for example, when the absolute value of the steering angle acquired from the steering angle sensor 8 is decreasing (i.e., when the steering angle of the steering wheel 6 is approaching the neutral position), the controller 16 determines that the steering wheel 6 is under a returning operation (that is, it is not under the turning operation). As a result, when the controller 16 determines that the steering wheel 6 is under the turning operation (Step S13: YES), it shifts to Step S14.

Figure 5:
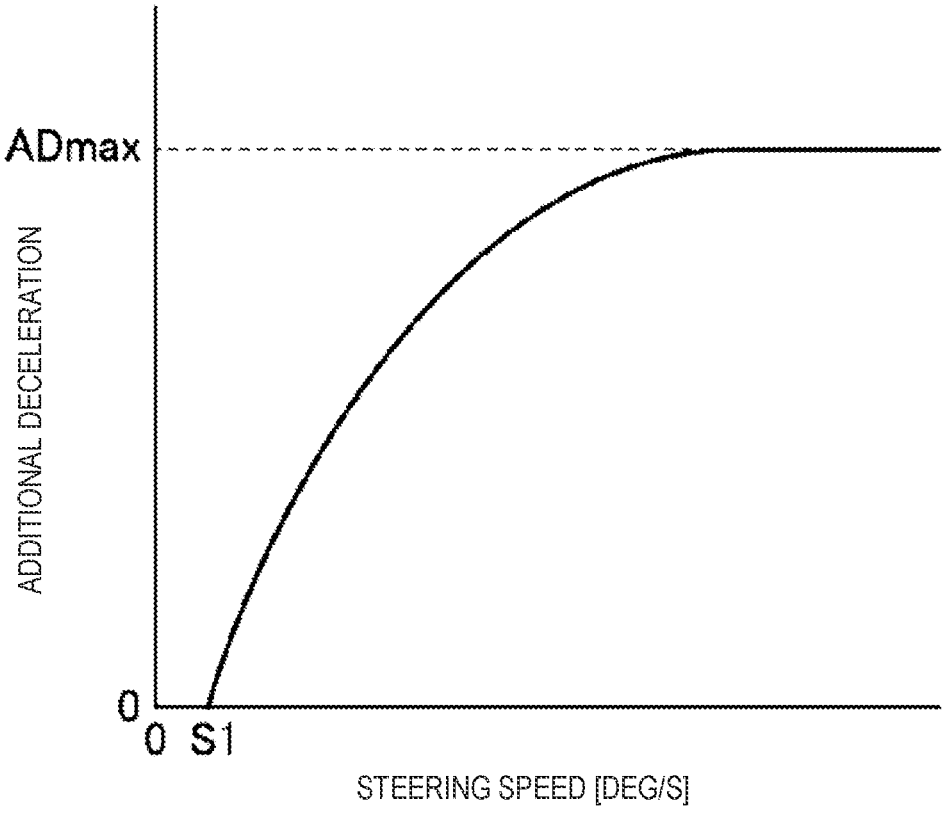
FIG. 5 is a map illustrating a relationship between a steering speed and an additional deceleration according to this embodiment.

Next, at Step S14, the controller 16 acquires the reducing torque based on the steering speed. In detail, before acquiring the reducing torque, the controller 16 first sets the additional deceleration corresponding to the current steering speed based on the relationship between the steering speed and the additional deceleration as illustrated in the map of FIG. 5. This additional deceleration is a forward deceleration to be added to the vehicle 1 according to the steering operation in order to control the vehicle attitude in accordance with the driver's intention of the turning operation of the steering wheel 6. In FIG. 5, the horizontal axis indicates the steering speed, and the vertical axis indicates the additional deceleration. As illustrated in FIG. 5, when the steering speed is below a threshold S1, the additional deceleration is 0. When the steering speed exceeds the threshold S1, the additional deceleration corresponding to this steering speed gradually approaches a given upper limit $AD_{max}$ as the steering speed increases. That is, as the steering speed increases, the additional deceleration increases, and an increasing rate of the amount of increase becomes smaller. This upper limit $AD_{max}$ is set to such a deceleration that, even if the deceleration is added to the vehicle 1 according to the steering operation, the driver does not sense a control intervention (for example, $0.5\ m/s^2 \approx 0.05$ G). Further, when the steering speed becomes above the given value, the additional deceleration is maintained at the upper limit $AD_{max}$. Then, the controller 16 acquires the reducing torque based on the additional deceleration set in this way. In detail, the controller 16 determines the reducing torque required for achieving the additional deceleration by the reduction of the basic torque, based on the current traveling speed, gear stage, road surface gradient, etc.

Next, at Step S15, the controller 16 acquires the currently selected traveling mode. The traveling mode can be acquired based on the signal outputted from the traveling mode switch 14 to the controller 16, for example.

Next, at Step S16, the controller 16 acquires a correction gain for correcting the reducing torque according to the traveling mode. In detail, the controller 16 acquires the correction gain corresponding to the current traveling mode based on the relationship between the traveling mode and the correction gain which are stored beforehand in the memory, etc.

The correction gain is set so that the reducing torque becomes larger when it is in the traveling mode in which the response of acceleration or deceleration of the vehicle 1 to the accelerator pedal operation is high, compared with in the traveling mode in which the response is low. For example, when the correction gain corresponding to the normal mode is set to 1, the correction gain corresponding to the sport mode is set to a value larger than 1 (for example, 1.1). Alternatively, when the correction gain corresponding to the sport mode is set to 1, the correction gain corresponding to the normal mode may be set to a value less than 1 (for example, 0.9). Further, if the number of traveling modes is three or more, the correction gain corresponding to each traveling mode is set so that the reducing torque becomes larger as the response of acceleration or deceleration of the vehicle 1 to the accelerator pedal operation in the traveling mode becomes higher.

Next, at Step S17, the controller 16 corrects the reducing torque acquired at Step S14 by using the correction gain acquired at Step S16. In detail, the controller 16 multiplies the correction gain acquired at Step S16 by the reducing torque acquired at Step S14. By correcting in this way, the reducing torque increases as the response of acceleration or deceleration of the vehicle 1 is higher.

Next, at Step S18, the controller 16 sets the reducing torque in this processing cycle so that a rate of change in the reducing torque becomes below a threshold, based on the reducing torque corrected at Step S17 and a threshold (defined beforehand and stored in the memory, etc.) which defines an upper limit of the rate of change in the reducing torque. After Step S18, the controller 16 ends the reducing torque setting processing, and returns to the main routine. In this case, at Step S5 of the torque decreasing control processing in FIG. 3, the controller 16 sets the final target torque based on the basic torque set at Step S3 and the reducing torque set at Step S18.

Further, at Step S13, when the controller 16 determines that the steering wheel 6 is not under the turning operating (Step S13: NO), in detail, for example, if the absolute value of the steering angle acquired from the steering angle sensor 8 is decreasing (i.e., if the steering angle of the steering wheel 6 is approaching the neutral position), the controller 16 ends the reducing torque setting processing, and returns to the main routine. In this case, the reducing torque becomes 0, and the basic torque set at Step S3 of the torque decreasing control processing illustrated in FIG. 3 becomes the final target torque.

<Operation and Effects>

Figure 6:
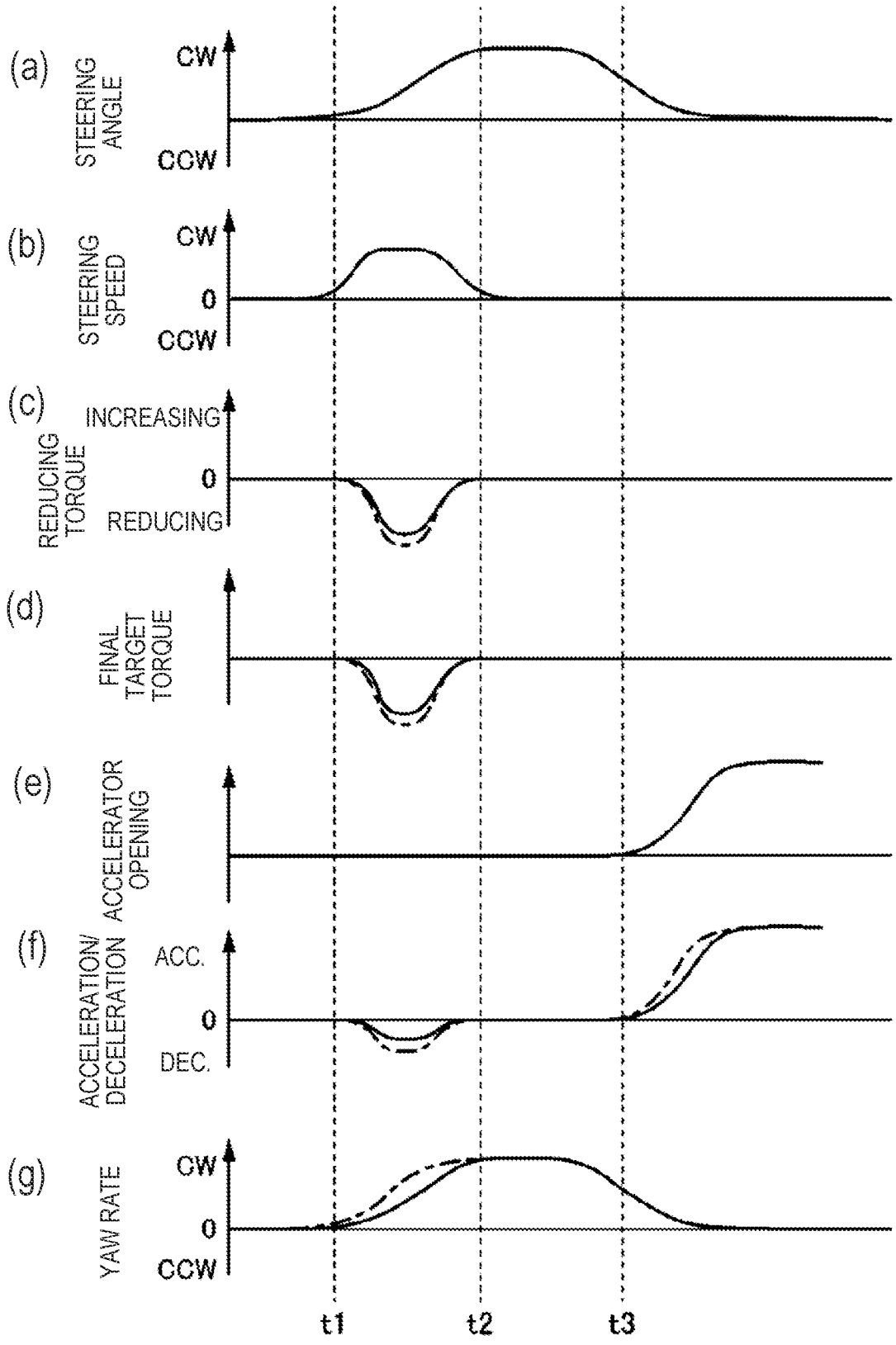
FIG. 6 is a time chart when performing the torque decreasing control according to this embodiment.

Next, referring to a time chart in FIG. 6, operation and effects of the control system for the vehicle according to this embodiment are described. FIG. 6 is a time chart when performing the torque decreasing control according to this embodiment. In FIG. 6, the horizontal axis indicates time. Further, the vertical axis indicates (a) the steering angle, (b) the steering speed, (c) the reducing torque, (d) the final target torque, (e) the accelerator opening, (f) the acceleration or deceleration, and (g) the yaw rate, sequentially from the top. In the graphs (c), (d), (f), and (g) of FIG. 6, solid lines illustrate a case where the traveling mode is the normal mode (here, when the correction gain is 1), and one-dot chain lines illustrate a case where the correction gain when the traveling mode is the sport mode (here, when the correction gain is larger than 1) is applied to the reducing torque.

In the example of FIG. 6, as illustrated in the graph (a), first, the turning operation of the steering wheel 6 in one direction is carried out in the clockwise (CW) direction from the neutral position, the rotational position of the steering wheel 6 is then held at a certain steering angle, the steering wheel 6 is returned to the neutral position, and the rotational position of the steering wheel 6 is then held at the neutral position. As illustrated in the graph (e) of FIG. 6, the accelerator opening is maintained so as to hold the traveling speed at an almost constant value from the start of the turning operation of the steering wheel 6 up to the middle of the returning operation, the accelerator opening then begins to increase in the middle of the returning operation, and after the rotational position of the steering wheel 6 returns to the neutral position, the accelerator opening is held at a certain position.

In connection with the turning operation of the steering wheel 6 in the CW direction from the neutral position being started, the steering speed (absolute value) in the CW direction increases. When the steering speed becomes above the threshold S1 at time t1, the controller 16 sets the reducing torque based on the steering speed so as to add the deceleration to the vehicle 1, and performs the torque decreasing control for reducing the torque generated by the engine 4. Then, the controller 16 increases the reducing torque (absolute value) according to the steering speed while the steering speed increases, and maintains the reducing torque when the steering speed becomes constant. Further, when the steering speed decreases, it decreases the reducing torque (absolute value) accordingly. Then, when the steering speed becomes below the threshold S1 at time t2, the controller 16 ends the torque decreasing control, and the reducing torque becomes 0. That is, the deceleration added to the vehicle 1 becomes 0.

The controller 16 applies the correction gain according to the traveling mode to the reducing torque, and performs the torque decreasing control with the corrected reducing torque. As described above, the correction gain applied to the reducing torque is set so that the reducing torque become larger when it is in the traveling mode in which the response of the acceleration or deceleration of the vehicle 1 to the accelerator pedal operation is high, compared with in the traveling mode in which the response is low. Therefore, the controller 16 increases the reducing torque (absolute value) when it is in the traveling mode in which the response of acceleration or deceleration of the vehicle 1 to the accelerator pedal operation is high (for example, when the traveling mode is the sport mode, as illustrated by the one-dot chain line in the graph (c) of FIG. 6), compared with when it is in the traveling mode in which the response is low (for example, when the traveling mode is the normal mode, as illustrated by the solid line in the graph (c) of FIG. 6). Thus, as illustrated in the graph (f) of FIG. 6, from time t1 to time t2, the deceleration (absolute value) added to the vehicle 1 by the torque decreasing control become larger when it is in the traveling mode in which the response of acceleration or deceleration of the vehicle 1 to the accelerator pedal operation is high, compared with when it is in the traveling mode in which the response is low. That is, the load added to the front wheels 2 by the torque decreasing control increases, and the cornering power of the front wheels 2 increases. Therefore, as illustrated in the graph (g) of FIG. 6, from time t1 to time t2, the rising of the yaw rate corresponding to the turning operation of the steering wheel 6 becomes quicker (the turnability of the vehicle 1 improves). That is, the response of the vehicle 1 to the steering operation becomes high.

Further, as described above, in the traveling mode in which the response of acceleration or deceleration of the vehicle 1 to the accelerator pedal operation is high (for example, the sport mode), the target acceleration is set higher than in the traveling mode in which the response is low (for example, the normal mode), for the same accelerator opening. Therefore, as illustrated in the graph (f) of FIG. 6, at or after time t3, when it is in the traveling mode in which the response of the acceleration or deceleration of the vehicle 1 to the accelerator pedal operation is high, the acceleration for the same accelerator opening becomes larger more than in the traveling mode in which the response is low. That is, in the sport mode, the response of the vehicle 1 to the steering operation becomes higher, and the response of acceleration or deceleration of the vehicle 1 to the accelerator pedal operation becomes higher than in the normal mode.

Thus, in this embodiment, the controller 16 acquires the current traveling mode which defines the response of the acceleration or deceleration of the vehicle 1 to the accelerator pedal operation, and when it determines based on the steering angle that the turning operation of the steering wheel 6 is performed, it performs the torque decreasing control so as to add the deceleration to the vehicle 1. When the acquired traveling mode is the traveling mode in which the response is high, the controller 16 increases the reduction amount of the torque in the torque decreasing control more than the traveling mode in which the response is low. Therefore, when the traveling mode in which the response of acceleration or deceleration of the vehicle 1 is high is selected, the response of acceleration or deceleration of the vehicle 1 to the accelerator pedal operation becomes higher, and the response of the vehicle 1 to the steering operation becomes higher than when the traveling mode in which the response is low is selected. Therefore, even when any of the traveling modes is selected, the response of the vehicle to the accelerator pedal operation and the response of the vehicle to the steering operation can be balanced, and the integrity can be given to the change in the response to each of the accelerator pedal operation and the steering operation when the traveling mode is changed.

Moreover, in this embodiment, since the controller 16 acquires the current traveling mode based on the operation to the traveling mode switch 14, it can change the response of the vehicle to the accelerator pedal operation and the response of the vehicle to the steering operation, according to the traveling mode selected reflecting the intention of the driver, while maintaining the integrity therebetween.

Further, since in this embodiment the controller 16 sets the reducing torque at least based on the steering angle detected by the steering angle sensor 8, it can promptly control the vehicle attitude to improve the response and the stability of the vehicle behavior with respect to the driver's steering operation.

<Modifications>

Although in the above embodiment of the present disclosure is applied to the vehicle 1 having the internal combustion engine as the driving force source, the present disclosure may also be applied to a vehicle having an electric motor as the driving force source. In this case, for example, current supplied to the electric motor from an inverter may be controlled in order to achieve the reducing torque in the torque decreasing control.

Although in the above embodiment the controller 16 acquires the current traveling mode based on the operation to the traveling mode switch 14, the current traveling mode (that is, the response of acceleration or deceleration of the vehicle 1 to the accelerator pedal operation) may be acquired, regardless of the operation to the traveling mode switch 14. For example, when the response of the acceleration or deceleration of the vehicle 1 to the accelerator pedal operation changes automatically according to the road surface situation or the traveling condition, the controller 16 may acquire the response of the acceleration or deceleration set in this way, and when the response of acceleration or deceleration is high, it increases the reduction amount of the torque in the torque decreasing control more than when the response is low.

Further, in the above embodiment, the controller 16 performs the torque decreasing control at least based on the steering angle detected by the steering angle sensor 8. However, instead of or in addition to the steering angle, the torque decreasing control may be performed based on the operating state of the vehicle 1 other than the accelerator pedal operation (a lateral acceleration, a yaw rate, a slip ratio, etc.). For example, the vehicle 1 may be provided with a yaw rate sensor (e.g., gyroscope 34) which detects the yaw rate of the vehicle 1 and an acceleration sensor (e.g., accelerometer 36) which detects the acceleration of the vehicle 1. The controller 16 may perform the torque decreasing control based on a steering angle related value, such as the yaw rate detected by the yaw rate sensor or the lateral acceleration detected by the acceleration sensor, instead of the steering angle. Each of the steering angle, the yaw rate, and the lateral acceleration is one example of a "steering angle related value" in the present disclosure.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Vehicle
2 Wheel
4 Engine
6 Steering Wheel
8 Steering Angle Sensor
10 Accelerator Opening Sensor
12 Vehicle Speed Sensor
14 Traveling Mode Switch
16 Controller

What is claimed is:

1. A control system for a vehicle, the control system comprising:

a driving force source configured to generate torque for driving drive wheels of the vehicle;

a steering angle related value sensor configured to detect a steering angle related value of a steering device of the vehicle; and a controller configured to control the torque generated by the driving force source to control an orientation of the vehicle based on the steering angle related value, wherein the controller is configured to:

acquire a current traveling mode defining a response of acceleration or deceleration of the vehicle to operation of an accelerator pedal;

based on the steering angle related value, when the controller determines that a turning operation of the steering device in one direction is carried out and the vehicle is at a beginning of slewing based on the turning operation, perform a torque decreasing control for reducing the torque generated by the driving force source so as to add deceleration to the vehicle; and when the acquired traveling mode is a traveling mode in which the response is high, increase a reduction amount of the torque in the torque decreasing control more than when in a traveling mode in which the response is low.

2. The control system of claim 1, further comprising a traveling mode selection switch configured to accept an operation for selecting one of a plurality of traveling modes, wherein the controller acquires the current traveling mode based on the operation of the traveling mode selection switch.

3. The control system of claim 2, wherein the steering angle related value is a steering angle.

4. The control system of claim 1, wherein the steering angle related value is a steering angle.

5. The control system of claim 1, wherein the steering angle related value is one of a steering angle, an angular velocity of the steering angle, a yaw rate, and a lateral acceleration.

6. The control system of claim 1, wherein the traveling mode in which the response is low is a normal mode, and the traveling mode in which the response is high is a sport mode in which a target acceleration of the vehicle corresponding to an accelerator opening is higher than that in the normal mode.

7. The control system of claim 5, wherein the steering angle related value is the angular velocity of the steering angle.

8. The control system of claim 1, the controller determines that the turning operation of the steering device in one direction is carried out when an angular velocity of the steering angle is greater than a predetermined threshold.

* * * * *